US005253723A

United States Patent [19]

Narvestad

[11] Patent Number: 5,253,723

[45] Date of Patent: Oct. 19, 1993

[54] RING CUTTER FOR TUNNEL DRILLING IN ROCK

[76] Inventor: Stein Narvestad, President
Harbitzgate 23A 0259, Oslo, Norway

[21] Appl. No.: 916,074

[22] PCT Filed: Jan. 26, 1990

[86] PCT No.: PCT/NO90/00018

§ 371 Date: Jul. 30, 1992

§ 102(e) Date: Jul. 30, 1992

[87] PCT Pub. No.: WO91/11588

PCT Pub. Date: Aug. 8, 1991

[51] Int. Cl.[5] ..... E21B 10/12; E21C 25/18

[52] U.S. Cl. ..... 175/373; 299/86

[58] Field of Search ..... 175/351, 371, 373, 374, 175/375; 299/79, 86

[56] References Cited

U.S. PATENT DOCUMENTS

| | | | |
|---|---|---|---|
| 3,981,370 | 9/1976 | Bingham et al. | 175/373 |
| 3,982,595 | 9/1976 | Ott | 175/373 |
| 4,004,645 | 1/1977 | Rees et al. | 175/373 |
| 4,793,427 | 12/1988 | Lambson et al. | 175/373 |

FOREIGN PATENT DOCUMENTS 8805117 7/1988 PCT Int'l Appl. .

*Primary Examiner*—David J. Bagnell
*Attorney, Agent, or Firm*—Kane, Dalsimer, Sullivan, Kurucz, Levy, Eisele and Richard

[57] ABSTRACT

A cutter head for drilling tunnels in rock includes a rotational body with a dove-shaped groove. A cutter ring formed of two substantially identical ring halves is clamped inside the groove by a clamping ring. Pins on the cutter ring extend into corresponding holes in the groove.

5 Claims, 1 Drawing Sheet

RING CUTTER FOR TUNNEL DRILLING IN ROCK

BACKGROUND OF THE INVENTION

A. Field of the Invention

The present invention is related to a ring cutter for tunnel drilling in rock, which cutter is secured to the rotation body of the cutter ring with a dovetail shaped cross section.

B. Description of the Prior Art

Tunnel drilling machines or full face machines are used with idle journalled ring cutters distributed on the surface of the cutter head, each ring thereby being subjected to strong wear as well as some deformation. Replacing such cutter rings in known embodiments, requires dismantling the cutter to remove the cutter ring itself. Some known cutter rings comprise several segments, however, this configuration is not practical in use of certain rock types. Other configurations use complete rings are used which therefore lead to relative expensive and time consuming replacement work which also for the operator also means requires heavy working.

SUMMARY OF THE INVENTION

With the cutter rings according to the present invention, a cutter ring in two parts is provided which is suitable for practical use and additionally may be replaced within a very short time. This is achieved with the cutter ring according to the present invention as defined with the features of the accompanying claims.

BRIEF DESCRIPTION OF THE DRAWINGS

In the drawings, FIG. 1, discloses an axial section of a cutter ring bearing and FIG. 2 discloses a side view of the bearing on FIG. 1.

DETAILED DESCRIPTION OF THE PREFERRED EMBODIMENT

Figure 1:
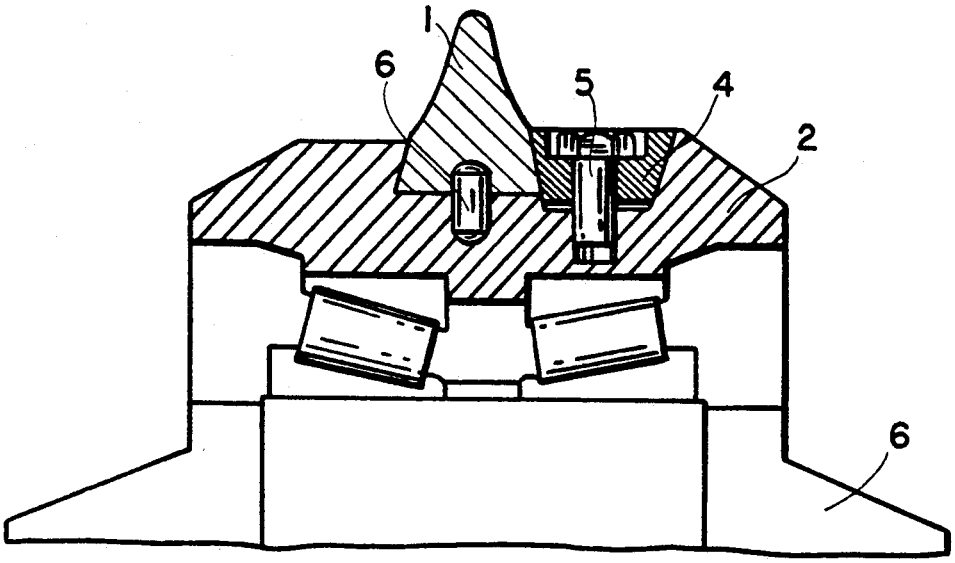
Figure 2:
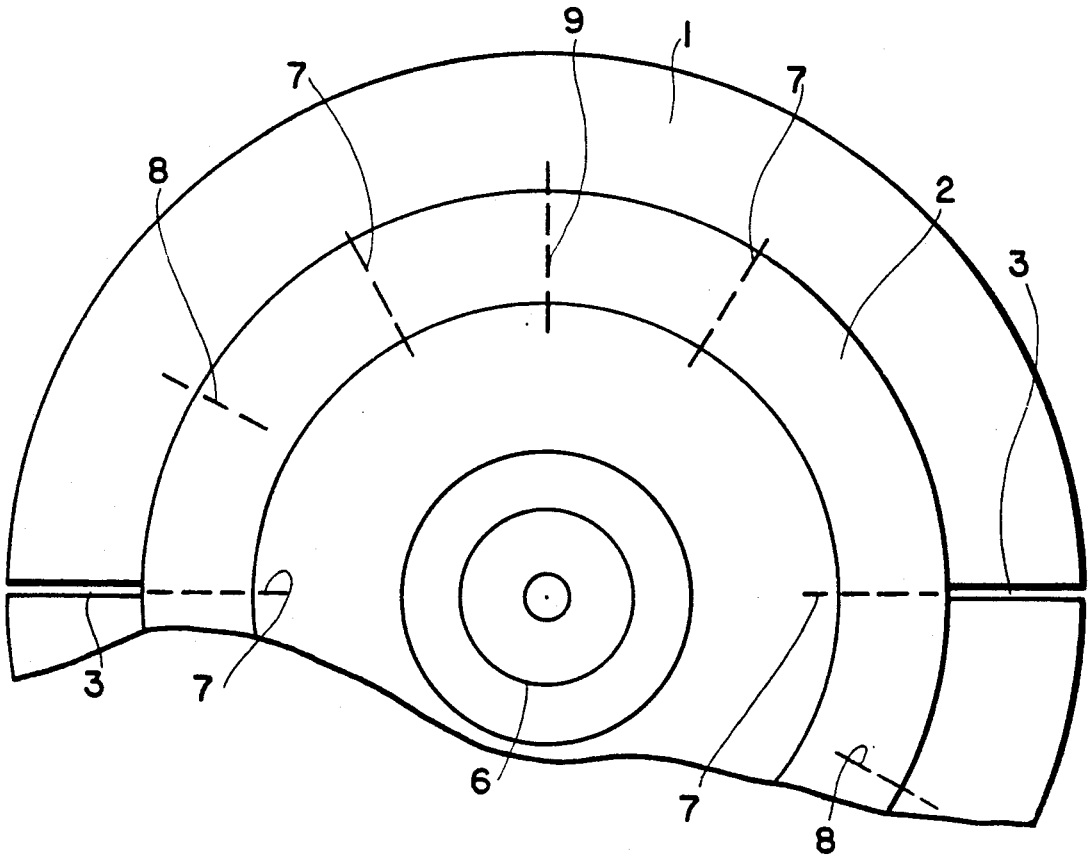

A rotational body 2 is journalled on a shaft 6 secured to the cutter head of the drilling machine. The outer circumference of the rotational body 2 is provided with a dovetail groove which in one side is expanded to a key way. In the dovetail groove are arranged diametrically opposed, two radially inwardly protruding pins 6, adapted for receipt in corresponding hole 9 in each cutter ring half 1. The holes 9 are arranged in the middle of the cutter ring halves 1. By inserting the two cutter ring halves 1 in the dovetail groove and with the pin 6 protruding into the hole 9, the cutter ring halves 1 may be displaced axially by a corresponding shape of the holes 9 in such a way that the cutter ring halves 1 may abut against the one half of the dovetail groove in the rotational body 2. Between the cutter ring halves 1, two gaps 3 with a dimension between 1.5 and 8 mm, preferably between 2 and 4 mm are provided. The gaps 3 have such a size that the cutter ring halves 1 can be manufactured by simple cutting of a complete cutter ring and the gap thereby is not that large to allow detrimental strokes will occur on the edge, as well known to be the case by larger gaps. On the other hand the gaps enable the cutter ring 1 to be deformed to a certain degree without closing the gap and thereby incur internal stress.

The cutter ring halves 1 are secured to the rotational body 2 by clamping rings 4 comprising two equal halves where the dimensions 8 between the two clamping ring halves preferably are offset 30° in relation to the gaps 3. The clamping rings 4 preferably have a wedge shaped cross section where one of the side surfaces is abutting against the cutter ring 1 and the other surface is abutting against a corresponding inclined surface in the rotational body 2.

The cutter ring is secured to the rotational body 2 by bolts 5 in axial planes 7 being offset 60° in relation to each other, and with the gaps 3.

By tightening of the bolt 5, the cutter ring 1 is pressed against one of the inclines surfaces of the dovetail groove in the rotational body 2, thereby secured with sufficient force.

The two pins 6 ensures that the cutter ring 1 will not rotate in relation to the rotation body 2 and the clamping ring 4.

Dismantling and assembling of a new cutter ring 1 is made very easy by removing the bolts 5 and the two halves of the clamping ring 4. Thereafter the cutter ring halves 1 easily can be replaced and the two halves of the clamping ring are again tightened by the bolts 5 with a force large enough to fix the cutter ring 1 to the rotation body 2.

I claim:

1. A cutter head for drilling tunnels in rock comprising:

a rotational body having a first and a second inclined surface defining a wedge-shaped groove, and pin openings;

a cutter ring formed of two substantially identical ring halves disposed in said groove, said ring halves having radially inwardly directed portions with a dovetail form abutting said first included surface;

diametrically oppositely arranged pins attached to said cutter ring halves and extending into said pin holes; and a clamping ring tightened radially inwardly by bolts and disposed between said cutter ring and said second included surface;

wherein said ring halves are separated by gaps, said gaps being peripherally offset from said pins by 90°.

2. The head of claim 1 wherein said clamping ring is composed of two clamping ring halves separated by divisions, said divisions being peripherally offset from said gaps by 30°.

3. The cutter head of claim 1 wherein said clamping means is tightened by six bolts, said bolts being arranged in three axial planes disposed at 60°, one of said planes passing through one of said gaps.

4. The cutter head of claim 1 wherein said gaps have a peripheral dimension in the range of 1.5–8 mm.

5. The cutter head of claim 4 wherein said gaps have a peripheral dimension in the range of 2–4 mm.

* * * * *